US006386913B1

(12) United States Patent
Mohammad et al.

(10) Patent No.: US 6,386,913 B1
(45) Date of Patent: May 14, 2002

(54) ELECTRICAL CONNECTOR FOR MICRO CO-AXIAL CONDUCTORS

(75) Inventors: Riaz Mohammad, York; Shannon Hower, Harrisburg, both of PA (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/639,487

(22) Filed: Aug. 14, 2000

(51) Int. Cl.[7] ..... H01R 9/05
(52) U.S. Cl. ..... 439/579
(58) Field of Search ..... 439/95, 579, 620, 439/701

(56) References Cited

U.S. PATENT DOCUMENTS 5,169,323 A * 12/1992 Kawai et al. ..... 439/95
5,240,424 A * 8/1993 Honma et al. ..... 439/95
5,257,949 A * 11/1993 Paulus ..... 439/620
5,290,191 A * 3/1994 Foreman et al. ..... 439/225
5,409,398 A * 4/1995 Chadbourne et al. ..... 439/490
5,855,493 A * 1/1999 Shelly ..... 439/465

FOREIGN PATENT DOCUMENTS

EP 0 570 650 A1 11/1993

OTHER PUBLICATIONS

Burndy Corp. Catalog., Monocrimp Contacts, pp. 3–51, 3–52, No date.

* cited by examiner

*Primary Examiner*—Brian Sircus
*Assistant Examiner*—Thanh-Tam Le
(74) *Attorney, Agent, or Firm*—Perman & Green, LLP

(57) ABSTRACT

A pin and socket electrical connector comprising an insulating housing, at least one contact, and a printed circuit board (PCB) section. The insulating housing has contact holding channels formed therethrough. The contact is mounted to the insulating housing. The contact is held in one of the contact holding channels in the housing with a terminal section of the contact extending from a portion of the housing. The PCB section is connected to the housing. The PCB section interfaces between a conductor terminated to the connector and the contact in the housing.

28 Claims, 10 Drawing Sheets

ELECTRICAL CONNECTOR FOR MICRO CO-AXIAL CONDUCTORS

BACKGROUND OF THE INVENTION

1. Field of the Invention

The present invention relates to electrical connectors and, more particularly, to co-axial electrical connectors for connecting co-axial cables having very small diameter signal/power conductors.

2. Prior Art

Termination of micro-conductors to pin or socket contacts in multi-contact pin and socket connectors of the prior art, is time consuming and sometimes unreliable. Each micro-conductor, whether a coaxial conductor, or- a twisted pair conductor, must be individually connected to a pin, or socket contact in the multi-contact connector. Micro-conductors, such as for example 40 AWG or smaller gage conductors, include a power/signal conductor of about 0.003" diameter or smaller. Conventional contacts for terminating micro-conductors, such as for example, the MONOCRIMP™ or TRIM TRIO™ coaxial contacts disclosed in Burndy catalog pages 3–51, 3–52, have an inner contact terminal with an opening sized for receiving the small gage power/signal conductor and a grounding outer contact. To connect the micro-conductors to each contact in the prior art, the power/signal conductor is inserted into the terminal opening of the inner contact, and the grounding conductor, or grounding sheath for coaxial conductors is inserted into the outer grounding contact. This process is repeated for each conductor terminated to the prior art multi-contact connector. Due to the small size of the conductors, and the small size of the openings in the contacts, insertion of the conductors into the contacts must be precise which has an adverse effect on the installation time for each conductor. When summed for all the conductors individually terminated to the multi-contact connector, the combined effect is significant In addition, the small size of the conductors, and contacts, and the configuration of the connection in the prior art, hampers the user's ability to determine whether a proper connection has been achieved between conductor and contact. This in turn has an adverse effect on the reliability of the connection between micro-conductors and pin and socket connectors in the prior art. The present invention overcomes the problems of the prior art as will be described in greater detail below.

SUMMARY OF THE INVENTION

In accordance with a first embodiment of the present invention, a pin and socket electrical connector is provided. The connector comprises an insulating housing, at least one contact mounted in the insulating housing, and a printed circuit board section connected to the housing. The insulating housing has contact holding channels formed therethrough. The contact mounted to the insulating housing is held in one of the contact holding channels of the insulating housing and has a terminal section of the contact extending from a portion of the housing. The printed circuit board section connected to the housing interfaces between a conductor terminated to the connector and the at least one contact in the housing.

In accordance with the second embodiment of the present invention, a pin and socket electrical connector is provided. The electrical connector comprises an insulating housing, coaxial contacts, and a terminal plate. The insulating housing has contact holding openings formed therein. The coaxial contacts are installed in the housing. Each coaxial contact, is held in a corresponding contact holding opening of the housing. The terminal plate is mounted to one end of the housing. The terminal plate has terminal pads for terminating electrical conductors to the terminal plate. Each of the coaxial contacts in the insulating housing is connected to at least one of the terminal pads. The coaxial contacts are disposed relative to the terminal pads on the terminal plate so that the coaxial contacts are connected to the at least one of the terminal pads in one step when the terminal plate is heated.

In accordance with the first method of present invention, a method for terminating an electrical conductor to an electrical connector is provided. The method comprises the steps of providing the electrical connector with an insulating housing, inserting a grounding sleeve into the insulating housing, inserting a pin or socket coaxial contact into the grounding sleeve, mounting a terminal plate to the insulating housing, and heating the terminal plate. The insulating housing has contact holding channels formed therein. The grounding sleeve is inserted into one of the contact holding channels of the insulating housing. The pin and socket coaxial contact is inserted into the contact holding channel having the grounding sleeve therein. The pin and socket coaxial contact is inserted through the grounding sleeve to effect a ground connection between the coaxial contact and grounding sleeve. The terminal plate is mounted to the insulating housing over the contact holding channel with the grounding sleeve and coaxial contact therein. The terminal plate has plated openings through which a portion of the grounding sleeve, and a terminal end of the coaxial contact extend. The plated openings are connected to solder pads on the terminal plate for terminating electrical conductors thereto. The terminal plate is heated to form a solder connection in one step between the grounding sleeve and the terminal plate, and between the coaxial contact and the terminal plate.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
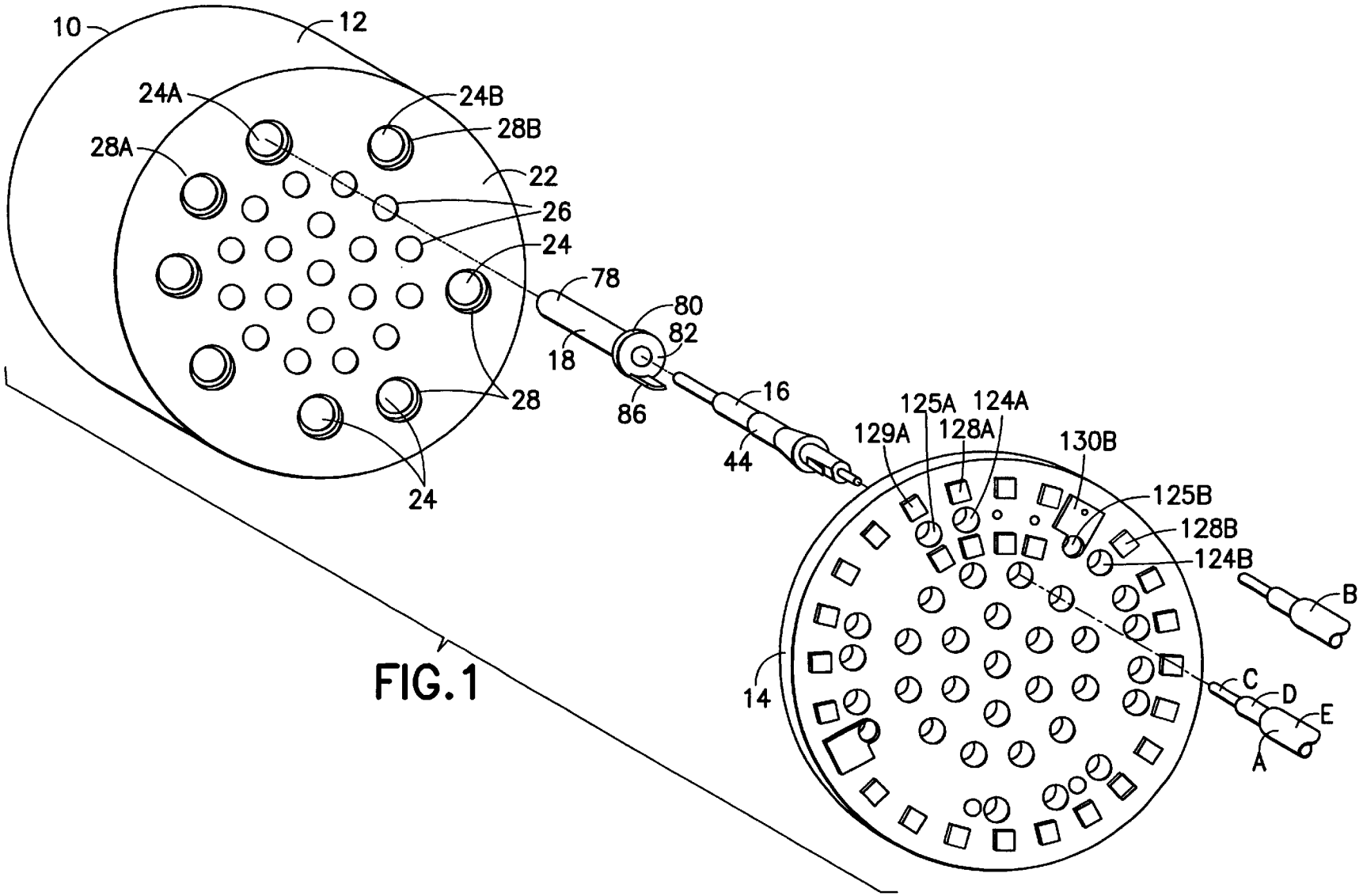
FIG. 1 is an exploded perspective view of a pin and socket connector incorporating features of the present invention, and two conductors.

Referring to FIG. 1, there is shown an exploded perspective view of a multi-contact electrical connector 10 incorporating features of the present invention, and two conductors A, B. Although the present invention will be described with reference to the single embodiment shown in the drawings, it should be understood that the present invention can be embodied in many alternate forms of embodiments. In addition, any suitable size, shape or type of elements or materials could be used.

Conductors A, B shown in FIG. 1, are coaxial conductors. Each conductor comprises an inner signal/power conductor C, and grounding sheath D surrounding the inner conductor. The grounding sheath D is disposed around the inner signal-power conductor C. The grounding sheath D is covered with an outer insulating layer E. The present invention will be described below with reference to the coaxial conductor shown in FIG. 1, though the present invention applies equally to any other suitable type of conductor such as for example a twisted pair conductor.

The multi-contact pin and socket connector 10 generally comprises an insulating contact housing 12, terminal or printed circuit board (PCB) section 14, pin or socket contact 16, and grounding sleeves 18 (only one contact 16, and one grounding sleeve 18 is shown in FIG. 1 for example purposes). The insulating housing 12 has contact holding channels therein. The grounding sleeves 18 and contacts 16 are located in the channels in the housing 12. The PCB section 14 is connected to the housing 12. The grounding sleeves IS and contacts 16 in the insulating housing 12 are mechanically, and electrically connected to the PCB section 14. The signal/power conductors C, and grounding sheath D of conductors A, B are terminated to the PCB section 14. The PCB section 14 interfaces between the contacts 16, and grounding sleeves 18 in the connector housing 12 and the conductors A, B terminated to the connector 10. The front end of the insulating housing 12 is sized and shaped so that it may be inserted into a mating pin and socket receptacle (not shown) to couple conductors A, B terminated to connector 10 to another device (not shown).

Figure 2:
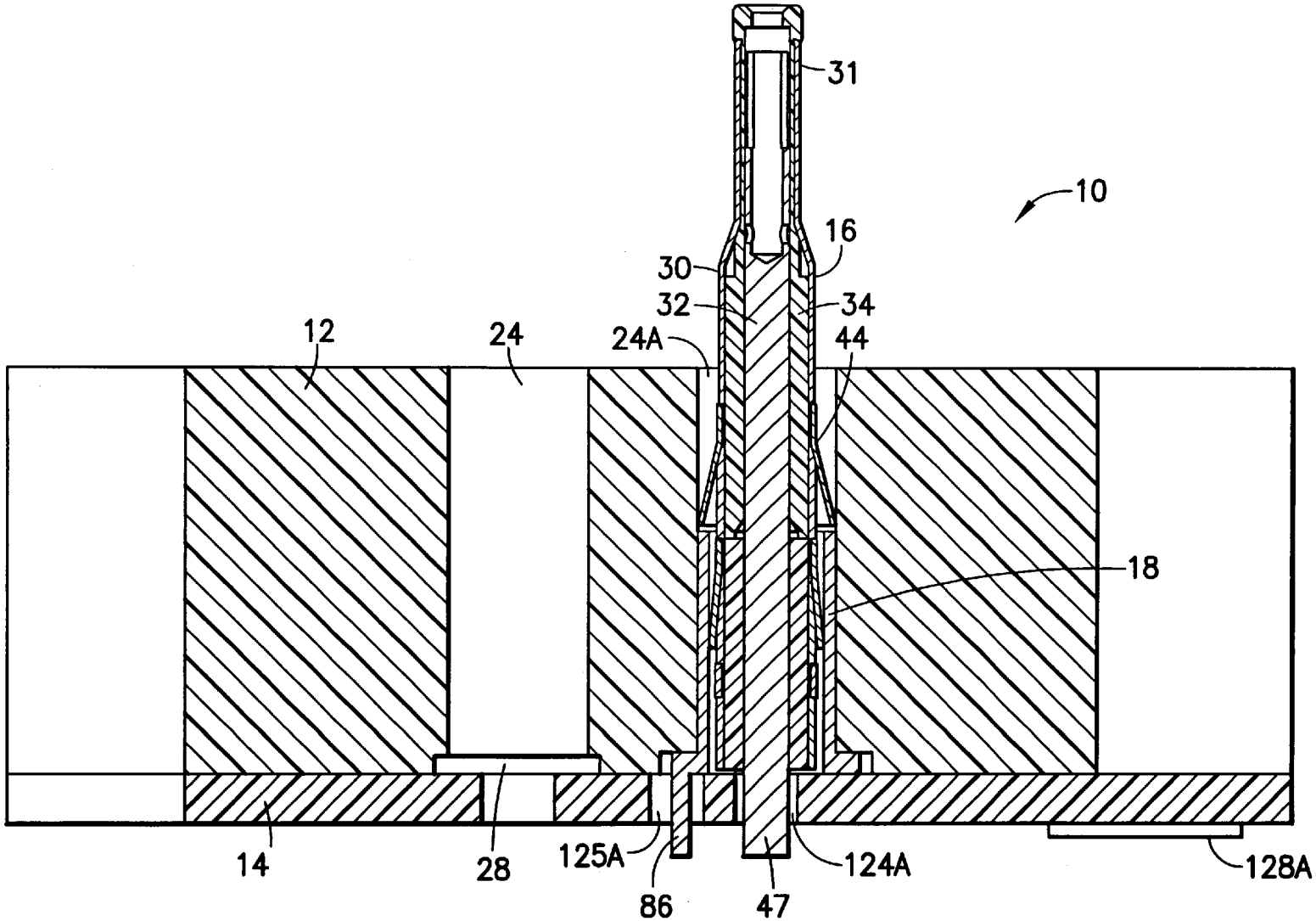
FIG. 2 is a partial cross-sectional view of the connector in FIG. 1.

Referring now also to FIG. 2, the housing 12 of the connector 10 is preferably a one-piece member made from a suitable insulating material, for example, a hard plastic such as glass filled plastic, or a soft elastomeric material, Alternatively, the housing of the connector may be made of metal. In the preferred embodiment, the housing 12 has a generally cylindrical shape. In alternate embodiments, the shape of the connector housing may be as desired, such as for example a general hexahedron shape. The front face 20 and rear face 22 of the housing 12 are substantially flat- As noted previously, the housing 12 has contact holding channels 24, 24A, 24B, 26 formed therein. The contact holding channels 24, 24A, 24B, 26 extend longitudinally through the housing 12 between the front 20 and rear faces 22 of the housing. Channels 24, 26, preferably, have a generally circular cross section, though the cross section of the channels in the housing may have any other shape to suit the exterior of the contacts located therein. In the preferred embodiment, channels 24 have a larger diameter than channels 26. The distribution of the contact holding channels 24, 26 in housing 12, shown in FIG. 1, is merely for example purposes only. Accordingly, one or more of the larger channels 24, 24A, 24B may be located closer to the center of the housing, and some of the smaller channels 26 may be located towards the periphery of the housing. The rear face 22 of housing 12 has counter bores 28 surrounding the openings of channels 24, 24A, 24B. In the preferred embodiment, the opening of each channel 24, 24A, 24B in the rear face 22 has a counter bore 28, 28A, 28B, though in alternate embodiments each channel opening in the rear face of the housing need not have a counter bore.

Figure 2A:
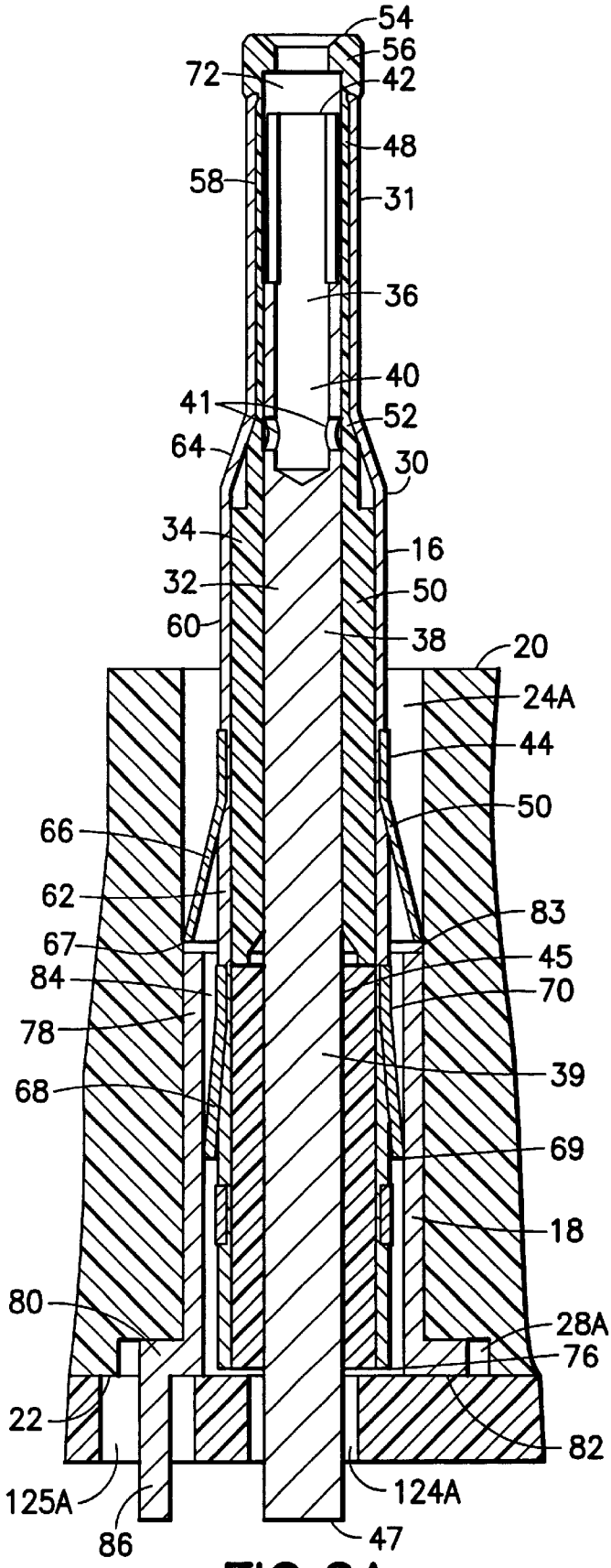
FIG. 2A is a second partial cross-sectional view of the connector in FIG. 1 showing an enlargement.

Referring now to FIGS. 2 and 2A, there is shown a cross sectional view of one of the contacts 16 housed in the insulating housing 12 of the connector 10. The contact 16 shown in FIGS. 2 and 2A is preferably a coaxial contact, such as for example a male or female TRIM TRIO™ coaxial contact from Burndy, although the housing 12 may house any other suitable type of contacts. The coaxial contact 16 generally comprises an outer shell 30, an inner or signal contact 32, and an insulating bushing 34 (see FIG. 2A). A retention sleeve 44 is disposed around the outer shell 30 of the coaxial contact (see also FIG. 1). In the preferred embodiment, the contact 16 has a front receptacle section 31. The inner signal contact 32 is a one-piece elongated metal member, such as for example, a screw machined signal contact. Accordingly, the signal contact 32 may have a substantially cylindrical shape or any other suitable shape. The signal contact 32 has a front section 36, mid-section 38, and rear section 39. The front section 36 of the signal contact 32 has a chamber 40 formed therein with an opening at the front end 42 of the inner signal contact. The front chamber 40 is sized and shaped to receive a conformal pin portion (not shown) of a mating contact (not shown). The inner contact member 32 may have any suitable number of extending tabs, protrusions, recesses or external flanges (not shown) disposed around any suitable portion of the inner contact member covered by the insulating bushing to hold the inner contact member in the bushing. The rear section 39 of the inner contact member generally has a spherical radius for termination to a PCB.

The insulating bushing 34 is made from any suitable insulating material such as plastic or a suitable elastomer. The insulating bushing 34 has a generally hollow cylindrical shape with an inner bore sufficient to receive the inner contact member 32 therein. The length of the insulating bushing 34 is preferably sufficient to cover the inner contact 32 as shown in FIG. 2A. The insulating bushing 34 has a front section 48, a rear section 50, and a transition section 52 therebetween. In the preferred embodiment, the outer diameter of the front section 48 is smaller than the outer diameter of the rear section 50. At its front end 54, the insulating bushing 34 may have an enlarged annular portion 56 for guiding the mating pin contact (not shown) into the front chamber 40 of the inner contact member 32.

The outer shell 30 of the contact 16 is preferably made of sheet metal of suitable gage, which is formed into a generally cylindrical shape. The outer shell 30 also includes a front section 58, a mid-section 60, and a rear section 62. In the preferred embodiment, the front section 58 has an outer diameter somewhat smaller than the outer diameter of the mid-section 60 and rear section 62 of the outer shell 30. A transition section 64 tapers between the narrower front section 58 and the wider mid-section 60. The rear section 62 depends from the mid-section 60 and extends to the end 76 of the outer shell.

The retention sleeve 44 is preferably a one-piece member. The retention sleeve 44 is made out of a suitable sheet metal rolled into a generally annular shape. The retention sleeve 44 has an inner diameter sized to contact the outer surface of the rear section 62 of the outer shell 30 when the sleeve is installed on the outer shell of the coaxial contact. The retention sleeve 44 has two sets of louvers comprising resiliently flexible tabs or lances 66, 68 projecting outward from the retention sleeve 44. The flexible lances may be cut into the sheet metal forming the sleeve 44 such that when the sheet metal is rolled to form the sleeve 44, the lances resiliently project outwards from the exterior 70 of the sleeve (see FIG. 2A). The lances 66, 68 are connected at the front to the sleeve 44 and have rear tips 67, 69 which are free. In the preferred embodiment, both the front set 66 and rear set 68 of lances respectively include at least two diametrically opposing lances. The retention sleeve 44 and outer shell 30 of the coaxial contact may include cooperating detents and recesses formed therein (not shown) to axially hold the retention sleeve 44 on the coaxial contact.

The insulating bushing 34 is disposed within the outer shell 30 as shown in FIG. 2A. The enlarged front section 56 of the insulating bushing 34 is located outside the shell 30. The transition section 52 of the insulating bushing is abutted against the tapered transition sections 64 of the outer shell. The rear section 50 of the insulating bushing 34 ends proximate the rear end 76 of the outer shell. The signal contact 32 is disposed within the insulating bushing 34 as shown in FIG. 2A. The front opening 54 of the insulating bushing 34 is substantially aligned with a chamber 40 in the signal contact 32, and acts as a guide opening for pin contacts inserted into the chamber. The insulating bushing 34 preferably covers the signal contact 32 within the outer shell 30. The rear end 47 of the signal contact extends below the end 76 of the outer shell 30 of the contact 16.

Also, as seen in FIG. 2A, the retention sleeve 44 is disposed around the rear section 62 of the outer shell 30. The retention sleeve 44 may be mounted on the outer shell 30 of the coaxial contact before placement of the signal contact 32 into the bushing 34, or at any other suitable time in the assembly of the coaxial contact. The outer shell 30 is inserted front first into the retention sleeve 44 until the retention sleeve 44 is located on the rear portion 62 of the outer shell 30 and the interlocking features (not shown) for axially holding the sleeve 44 on the outer shell engage. The tapered transition section 64 of the outer shell 30 helps guide the shell into the retention sleeve 44. When in the installed position shown in FIG. 2A, the retention sleeve 44 makes close contact with the periphery of the outer shell 30 thereby providing grounding contact between shell and sleeve.

Still referring to FIGS. 1–2A, the grounding sleeve 18 is preferably a one-piece member made of metal such as for example steel, aluminum, or copper alloy. In alternate embodiments, the grounding sleeve may be a multi-piece member. The grounding sleeve 18 has a generally hollow cylindrical body 78 with an exterior radial flange 80 at the rear end 82. The body 78 of the sleeve 18 is sized to be admitted into the contact holding channels 24, 24A, 24B in the insulating housing 12. In the preferred embodiment, the cylindrical body 78 of the sleeve 18 forms a close fit in the contact holding channels 24, 24A, 24B of housing 12 (see FIG. 2A). In alternate embodiments, the body of the grounding sleeve may form a clearance fit with the contact holding channels in the insulating housing. The exterior radial flange 80 is sized to be admitted into the counter bores 28, 28A, 28B at the end of the contact holding channels 24, 24A, 24B, but cannot be admitted into the holding channels. The flange 80 has a thickness which complements the depth of the counter bore 28, 28A, 28B as shown in FIG. 2A, so that when the sleeve is inserted into the channel, the rear end 82 of the grounding sleeve 18 is substantially flush with the rear face 22 of the housing 12. The inner opening 84 of the grounding sleeve 18 is sized to admit the coaxial contact 16 therethrough. As seen best in FIG. 2A, the radial flange 80 of the grounding sleeve 18 has a tail, or post 86 depending therefrom. The post 86 projects rearward from the rear end 82 of the sleeve 18. The post 86 may have any suitable shape, such as for example a cylindrical shape, or hexahedron shape, and may be located as desired on the radial flange. In the preferred embodiment, post 86 is offset radially relative to the body 78 of the sleeve, though in alternate embodiments, the post may be aligned with the body.

Figure 3:
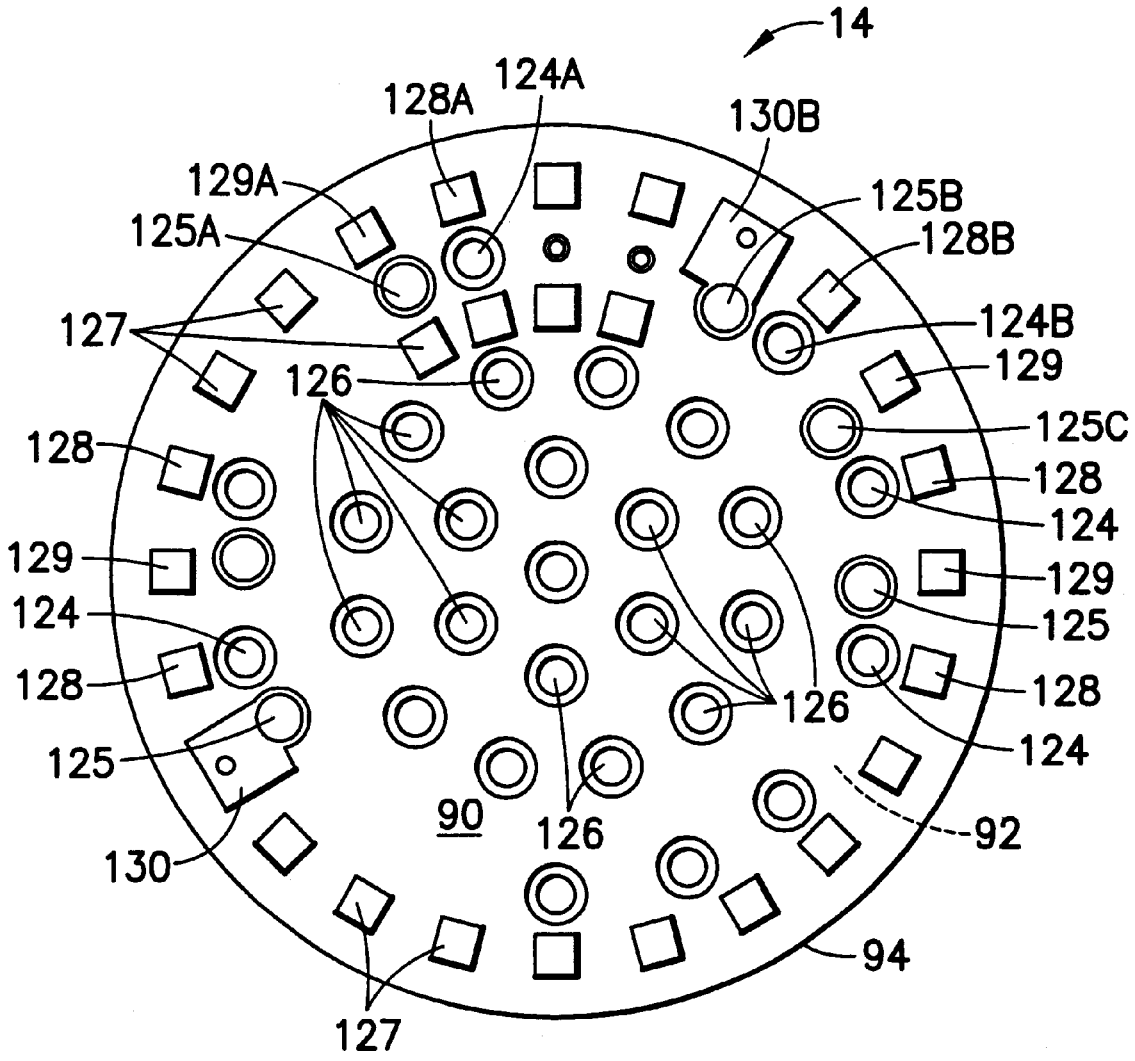
FIG. 3 is a rear end elevation view of the connector in FIG. 1 in accordance with a first preferred embodiment of the present invention.

Referring now also to FIG. 3, there is shown a rear end elevation view of the PCB section 14 of the connector 10 in accordance with a first preferred embodiment of the present invention. Still referring to FIG. 1, the PCB section 14 generally comprises a board 90 with a printed circuit 92 disposed thereon. The board 90 is preferably a one-piece member made of a suitable dielectric material. The board 90 may include a conductive substrate, or cladding (not shown) for forming the printed circuit 92 on the board 90. The printed circuit 92 may be any suitable circuit and may be formed on the board by any suitable means. As shown in FIG. 1, in the preferred embodiment, board 90 has a circular circumference sized to substantially cover the rear face 22 of the insulating housing 12. In alternate embodiments, the board may have any other suitable shape, and may cover part of the insulating housing or otherwise may extend outwards from the housing as desired. Board 90 has signal/power contact holes 124, 124A, 124B, 126 and grounding contact holes 125, 125A, 125B formed therethrough (see FIG. 3). Signal/power contact holes 124, 124A, 124B correspond to the larger contact holding channels 24, 24A, 24B in insulating housing 12 (see FIG. 1). Signal/power contact holes 126 correspond to contact holding channels 26 in the insulating housing 12. In the preferred embodiment, each signal contact hole 124, 124A, 124B in board 90 has an adjacent grounding contact hole 125, 125A, 125B as shown in FIG. 3. Signal contact holes 124, 124A, 124B are sized to admit therein the end 47 of inner signal contact 32 of coaxial contact 16. Grounding contact holes 125, 125A, 125B in board 90 are sized to admit therein the post 86 of grounding sleeve 18. Signal contact holes 124, 124A, 124B, 126, and grounding contact holes 125, 125A, 125B are plated to form a solder connection to the contact inside each hole. Board 90 also has signal/power solder pads 127, 128, 128A, 128B, and grounding solder pads 129, 129A, 130, 130B disposed on the rear face 94 of the board (see FIG. 3). The signal solder pads, and grounding solder pads are used for terminating signal/power conductors and grounding conductors to the connector 10 as will be described in greater detail below, In the preferred embodiment, each signal contact hole 124, 124A, 124B in board 90 is electrically connected by printed circuit 92 to a corresponding signal/power solder pad 128, 128A, 128B. Thus, for example, signal contact hole 124A is connected to corresponding solder pad 128A, and signal contact hole 124B is connected to signal solder pad 128B. In alternate embodiments, each signal contact hole may be electrically connected to several solder pads, or conversely several contact holes may be connected to one solder pad. Each grounding contact hole 125, 125A, 125B is electrically connected by printed circuit 92 to at least one grounding solder pad. In the preferred embodiment, board 90 includes a common grounding plane to which the printed circuit is connected. The common grounding plane has common grounding solder pads 130, 130B. Each common grounding solder pad 130, 130B may be connected via the printed circuit to one or more grounding contact holes. By way of example, common grounding solder pad 130B may be connected to grounding contact hole 125B and grounding contact hole 125C (see FIG. 3). Board 90 may also include discrete grounding solder pads 129, 129A. Each of the discrete grounding solder pads 129, 129A is connected to a corresponding grounding contact hole 125, 125A. Signal solder pads 128, 128A, 128B, and grounding solder pads 129, 129A, 130, 130B are shown as being disposed proximate the edge 94 of the PCB section 14, though in alternate embodiments the solder pads may be disposed on the board as desired. Signal solder pads 127 may be connected electrically to signal contact holes 126.

Figure 4:
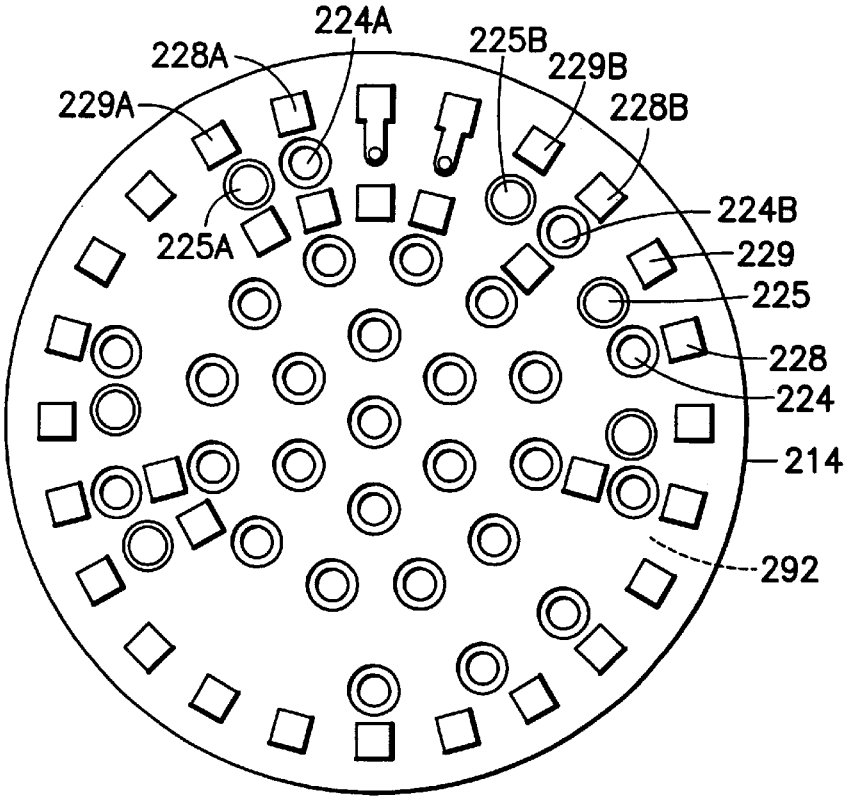
FIG. 4 is another rear end elevation view of the connector in accordance with a second preferred embodiment of the present invention.
Figure 5:
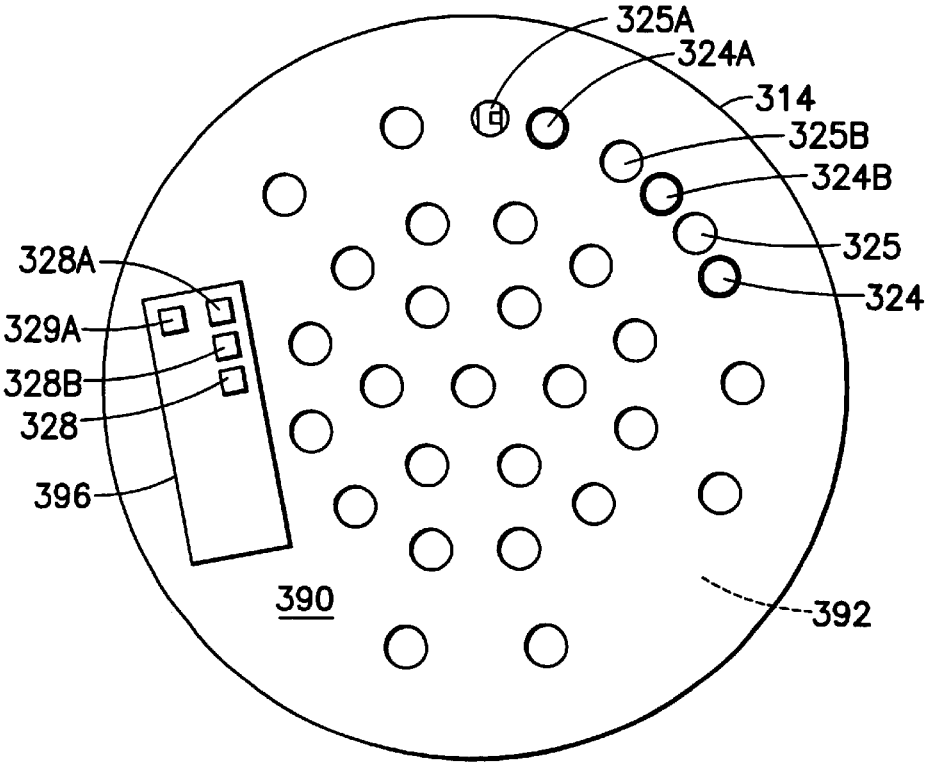
FIG. 5 is still another rear end elevation view of the connector in accordance with a third preferred embodiment of the present invention.

Referring now to FIG. 4, there is shown a rear end elevation view of a PCB section 214 of the connector in accordance with a second preferred embodiment of the present invention. The PCB section 214, in this embodiment, is substantially similar to PCB section 14 described previously, and shown in FIGS. 1, and 3, except as noted below. Similar features of PCB section 214 in FIG. 4 and PCB section 14 in FIGS. 1 and 3 have similar reference numbers. The PCB section 214 includes discrete grounding solder pads 229, 229A, 229B, each being connected by portions of the printed circuit 292 to is corresponding grounding contact hole 225, 225A, 225B. In this embodiment, the PCB section 214 may not be provided with a common grounding plane connecting common grounding solder pads to several grounding contact holes. Referring now to FIG. 5, there is shown a rear end elevation view of a PCB section 314 of the connector in accordance with a third preferred embodiment of the present invention. The PCB section 314 is substantially similar to PCB section 14 described before and shown in FIGS. 1 and 3, except as noted below. Similar features of the PCB section 314 and PCB section 14 have similar reference numbers. As seen in FIG. 5, PCB section 314 has solder pads 328, 328A, 328B, 329A segregated in one area 396 of the board 390. In alternate embodiments, the solder pads may be distributed into two or more common area on the PCB section similar to area 396 in FIG. 5. The solder pads in common area 396 include both signal/power solder pads 328, 328A, 328B, and grounding solder pads 329 (only one ground solder pad 329 is shown in FIG. 5 for example purposes). The respective signal/power solder pads 328, 328A, 328B are electrically connected via printed circuit 392 to corresponding signal contact holes 324, 324A, 324B in the board 390. Solder pad 329A may be a common grounding solder pad part of a common grounding plane for all grounding contact holes 325, 325A, 325B in board 390.

Referring now again to FIGS. 1–3, the connector 10 may be assembled in a manner generally as follows. Grounding sleeve 18 is inserted into the desired contact holding, for example, channel 24A, of the insulating housing 12. Although only one grounding sleeve is shown in FIG. 1, for example purposes, similar grounding sleeves may be installed into each of the larger contact holding channels 24, 24B of the housing 12. In alternate embodiments, some of the larger contact holding channels need not have a grounding sleeve inserted therein. As shown in FIG. 1, the grounding sleeve is inserted front end first through the rear face 22 of the housing 12. The radial flange 80 is seated into the counter bore 28A in the housing. The radial flange 80 acts as a stop preventing further insertion of the grounding sleeve 18 into the housing 12. Coaxial contact 16 is inserted into the contact holding channel 24A through the bore in the grounding sleeve 18. Coaxial contact 16 is inserted front end 54 first through the rear end 82 of the grounding sleeve 18 in the housing 12. In alternate embodiments, the grounding sleeve and coaxial contact may be pre-assembled, and the assembly installed as a unit into the insulating housing. Other coaxial contacts (not shown) similar to coaxial contact 16 may be inserted in any other contact holding channel 24, 24B, of the insulating housing 12 as desired. Still other contacts (not shown) which may also be coaxial contacts, may be inserted into the smaller signal/power contact holding channels 26 of housing 12. When coaxial contact 16 is inserted through the grounding sleeve 18, the first and second set of lances 66, 68 which angle outwards from the retention sleeve 44 on the outer shell 30 contact the sleeve 18 and are resiliently deflected inwards (see FIG. 2A). The contact 16 is inserted forwards until the first set of lances 66 exits the grounding sleeve 18. As the tips 67 of the first set of resilient lances 66 of contact 16 pass the front lip 83 of grounding sleeve 18, the lances 66 resile outwards such that an audible noise or click sound may be heard which indicates that the contact 16 is in the installed position shown in FIG. 2A. In addition, the grounding sleeve may have locating surfaces (not shown) formed in the inner bore which are engaged by the second set of resiliently flexible lances 68 to stop and hold the coaxial contact 16 in its is installed position in the grounding sleeve 18. The rear set of lances 68 of the contact 16 are biased against the body 78 of the grounding sleeve, thereby effecting a grounding connection between the retention sleeve on the outer shell 30 of the coaxial contact 16 and grounding sleeve 18. The outward pressure exerted by the second set of lances 68 against the grounding sleeve 18 also provides a mechanical connection between a contact and grounding sleeve. As shown in FIG. 2A, when the coaxial contact 16 is in its installed position the front lances 66 are biased outwards against the sides of the channel 24A. The tips 67 of the front lances 66 engage into the housing 12 preventing withdrawal of the coaxial contact 16 from the housing 12. The grounding sleeve which is secured to the contact 16 by the rear set of lances 68 is thus also retained in the housing 12. As shown in FIGS. 2, 2A, the front section 54 of the contact 16 projects out from the front 20 of the housing 12. The rear 47 of the inner signal contact 32 of the coaxial contact 16 projects from the rear 22 of the housing 12. Also projecting from the rear 22 of the housing 12 is the post 86 on the grounding sleeve 18. Hence, each contact holding channel 24, 24A, 24B which contains a grounding sleeve 18, and coaxial contact 16 therein has the rear 47 of an inner signal contact 32, and a grounding post 86 of the grounding sleeve 18 projecting from the rear face 22 of the housing 12.

The PCB section 14 is placed over the rear face 22 of the insulating housing 12. PCB section 14 is orientated to align the signal/power contact holes 124, 124A, 124B, 126 with the corresponding contact holding holes 24, 24A, 24B, 26 in the insulating housing. The insulating housing and PCB section may include polarizing features (not shown) such as for example mating guide rails which guide placement of the PCB section on the rear face of the insulating housing and align the contact holes in the PCB section with contact holding channels in the housing. When PCB section 14 is positioned against the rear face 22 of housing 12, the rear 47 of the inner signal contact 32 of the coaxial contact 16 in the housing extend into the corresponding signal contact holes. By way of example, as seen in FIGS. 2, 2A, the rear end 47 of the signal contact 32 of coaxial contact 16 held in channel 24A of the housing is located in signal contact hole 124A of PCB section 14. In the preferred embodiment, the rear 47 of signal contact 32 extends through the-PCB section, although in alternate embodiments, the rear of the signal contact may be within the PCB section. The grounding post 86 on the grounding sleeve 18 in each of the contact channels 124, 124A, 124B is placed through the grounding contact hole 125, 125A, 125B adjacent each of the signal contact holes 124, 124A, 124B in the PCB section 14 corresponding to the channels 24, 24A, 24B in the housing 12. For example, as shown in FIGS. 2, 2A, the grounding post 86 of grounding sleeve 18 in channel 24A is located in the grounding contact hole 125A of PCB section 14. Also, as shown in FIGS. 2, 2A, the radial flange 80 of the grounding sleeve 18 is captured by PCB section 14 in counter bore 28A. The PCB section 14 may be connected to the insulating housing 12 if desired with any suitable adhesive or by mechanical means (not shown) such as clamping, or fastening. Otherwise, the PCB section 14 may merely be seated against the rear face 22 of the insulating housing 12 until installation is completed The terminal ends of signal/power contacts (not shown) in the smaller contact holding channels 26 of the insulating housing 12 may be located, or extend through corresponding contact holes 126 in the PCB section 14. The PCB section 14 is connected to the rear 47 of the signal contacts 32 and the grounding posts 86 located in plated holes 124, 124A, 124B, 125, 125A, 125B by heating or passing a solder wave over the PCB section 14. The PCB section 14 may be heated by any suitable means such as a suitable oven or heating element disposed to cause the plating in each of the contact holes 124, 124A, 124B, 125, 125A, 1253 to flow and form a solder or brazed connection with the terminal 32, and post 86 in each plated hole. In this manner, the signal contacts 32 of coaxial contacts 16, and the grounding posts 86 of grounding sleeves 18 in the insulating housing are connected to the PCB section substantially simultaneously. Any signal contact (not shown) in holding channels 26 of the housing with terminals in plated contact holes 126 are thus also connected at the same time to the PCB section 14. The solder connection formed to the rear 47 of each signal contact 32 of coaxial contact 16 electrically connects the signal contact via the printed circuit 92 in PCB section 14 to the corresponding signal/power solder pad 128, 128A, 128B- For example, as shown in FIG. 2, the solder connection to inner signal contact 32 in hole 124A of the PCB section, electrically connects inner signal contact 32 to signal/power solder pad 128A. The solder connection to the grounding post 86 of each grounding sleeve 18 in housing 12 electrically connects the grounding sleeve 18, and hence, the outer shell of the coaxial contact 16, which is grounded to the grounding sleeve, to the corresponding grounding solder pad 129, 129A, 130, 130B. For example, the solder connection to the post 86 of grounding sleeve 18 in channel 24A is connected to the grounding solder pad 129A. In the case where, the grounding sleeve post (similar to post 86) is located in a grounding hole 125S, 125C connected by a common grounding plane to the common grounding solder pad 130B (for example), the solder connection grounds these posts to the common ground solder pad 130B. The solder connection to the grounding post 86 and the rear of the inner signal contact 32 also helps mechanically secure the PCB section 14 to the insulating housing 12. As described previously, the front set of lances 66 of each coaxial contact 16 engages the insulating housing 12, and holds the contact 16 fixed in the housing 12 (see FIG. 2A). The solder connection between the PCB section 14 and rear 47 of inner signal contact 32 of each coaxial contact 16 attaches the PCB section 14 to the coaxial contact which is fixed by lances 66 in the insulating housing 12 thereby also fixing the PCB section 14 to the insulating housing.

The coaxial conductors terminated to connector 10, such as coaxial conductors A, B, are preferably connected to solder pads 127, 128, 128A, 128B, 129, 129A, 130, 130B on PCB section 14. Each conductor is soldered to an appropriate solder pad on the PCB section 14. For example, coaxial conductor A which is to be connected to contact 16, is stripped to expose the inner signal/power conductor C, and its outer grounding sheathing D. The sheathing D is soldered to grounding solder pad 129A which is groundingly connected, as described before, to the grounding post 86 of grounding sleeve 18. This forms a grounding connection from the sheathing D to the outer shell 30 of the contact 16. The inner signal/power conductor C of conductor A is soldered to solder pad 128A, which is electrically connected to the inner contact 32 of coaxial contacts 16 in the housing. This forms a signal-power connection between conductor C and the signal-power contact 32 of coaxial contacts 16. The PCB section 14 interfaces between the conductor A and the corresponding coaxial contact 16. In a manner similar to that described above, the inner signal/power conductor C of each conductor connected to connector 10 is soldered to the signal/power solder pads 128, 128B thereby terminating the conductors to the signal/power contacts in the connector. The metal sheathing D on some conductors such as conductor B, may be soldered to common grounding solder pads 130, 130B. The conductors A, B to be connected to the PCB section 14 may be placed in a clamp, or fixture (not shown) to hold the conductors A, B in appropriate position, and then soldered to the solder pads on the PCB section at the same time the coaxial contacts, and grounding sleeves, are soldered in the grounding holes of the PCB section. Otherwise, each conductor may be independently soldered to the appropriate solder pad on the PCS section.

In the case of PCB section 214, shown in FIG. 4, installation in the connector, and termination of the conductors to the connector is substantially the same as described above. In this embodiment, however, the outer sheathing (similar to sheathing D in FIG. 1) of each conductor is soldered to a discrete grounding solder pad 229, 229A, 229B as PCB section 214 has no common grounding solder pads. In the case of PCB section 314, shown in FIG. 5, the signal/power conductors, and outer sheathings (similar to conductor C, and sheathing D in FIG. 1) are respectively connected to the appropriate signal solder pads 328, 328A, 328B and to the common grounding solder pad 329A in region 396. Otherwise, installation of PCB section 314 on the connector proceeds substantially the same as described before with reference to PCB section 14 in FIGS. 1–3.

The aforementioned procedures for the manufacture of connector 10 and termination of conductors such as conductors A, B to the contacts 16 on the connector is merely exemplary, and any other suitable procedure may be used. For example, the grounding sleeves 18, and coaxial contacts 16 need not be inserted into the insulating housing 12 before being connected to the PCB section 14. Rather, in alternate embodiments, the grounding post on the grounding sleeves, and the end of the inner signal contact of the coaxial contacts may be soldered to the PCB sections before the PCB section is connected to the insulating housing. In other alternate embodiments, the conductors may be soldered to the PCB section before the PCB section is mounted on the insulating housing of the connector.

Figure 6:
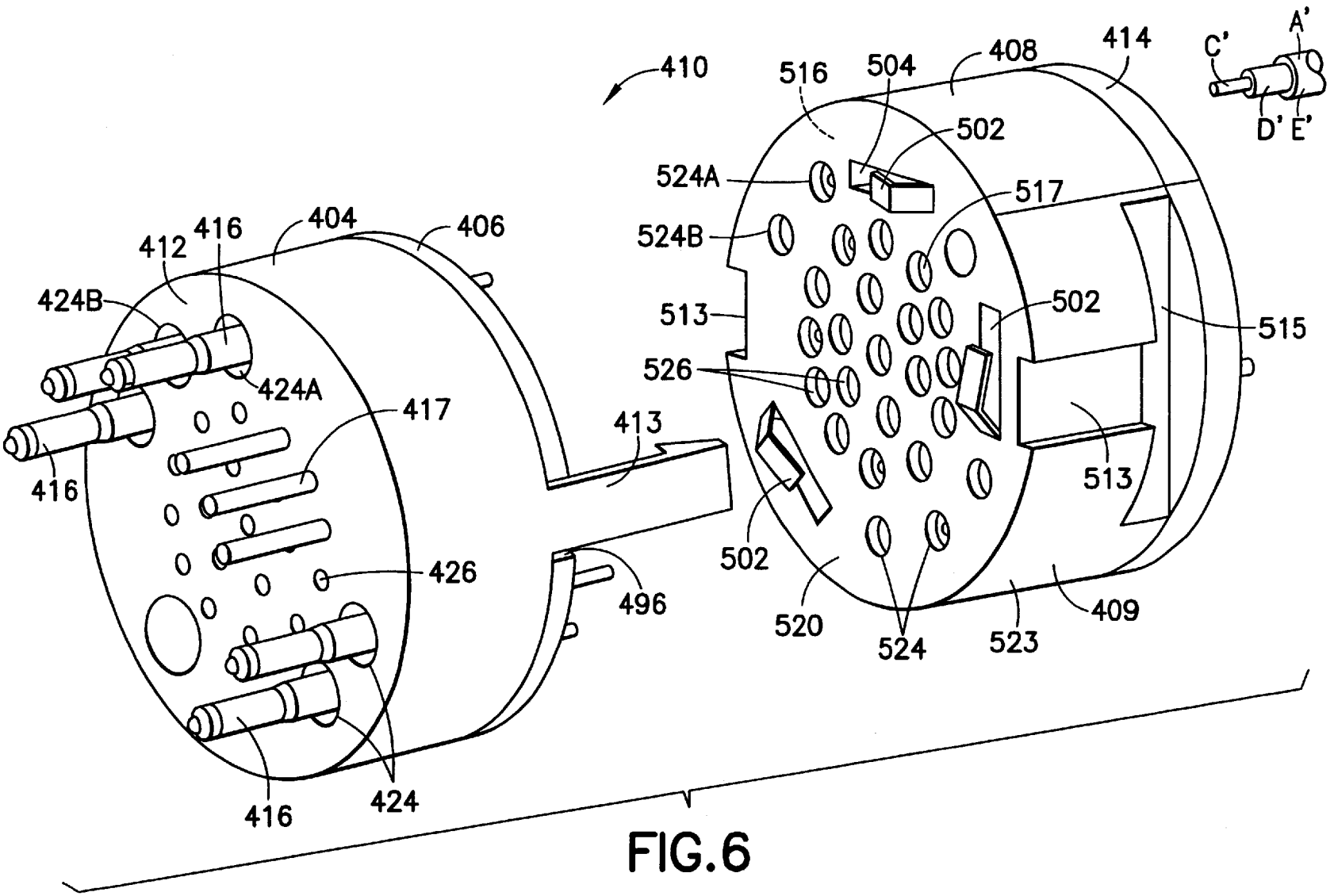
FIG. 6 is an exploded perspective view of a pin and socket connector in accordance with a fourth preferred embodiment of the present invention, and a co-axial conductor.

Referring now to FIG. 6, there is shown an exploded perspective view of a pin and socket connector 410 in accordance with a fourth preferred embodiment of the present invention, and a coaxial conductor A' which is to be terminated to the connector. Conductor A' is substantially the same as conductors A, B described previously with reference to FIG. 1, similar features of the conductors are similarly identified. In this preferred embodiment, the connector 410 generally comprises a replaceable housing section 404, and an adapter section 408. The replaceable housing section includes an insulating housing 412 which houses contacts 416, 417. The replaceable housing section is adapted to be inserted into a mating replaceable (not shown) The replaceable housing section 404 further includes a grounding plate 406 mounted to the insulating housing 412. The adapter section 408 of the connector 410 comprises a conducting block 409 and a PCB section 414. The conductor A' is terminated to the PCB section 414 of the connector. The conducting block includes intermediate contact assemblies 516, 517 adapted for mating with the contacts 416, 417 in the replaceable housing section for effecting an electrical connection between the contacts in the replaceable housing sections 404 and the conductor A' connected to the PCB section 414. The replaceable housing section 404 is removably mounted to the adapter section 408. The connector 410 also includes springs 502 which are compressed between the replaceable housing section 404 and adapter section 408 to effect contact between the grounding plate 406 and the conducting block 409 when the replaceable housing section 404 and adapter section 408 are assembled.

Figure 7:
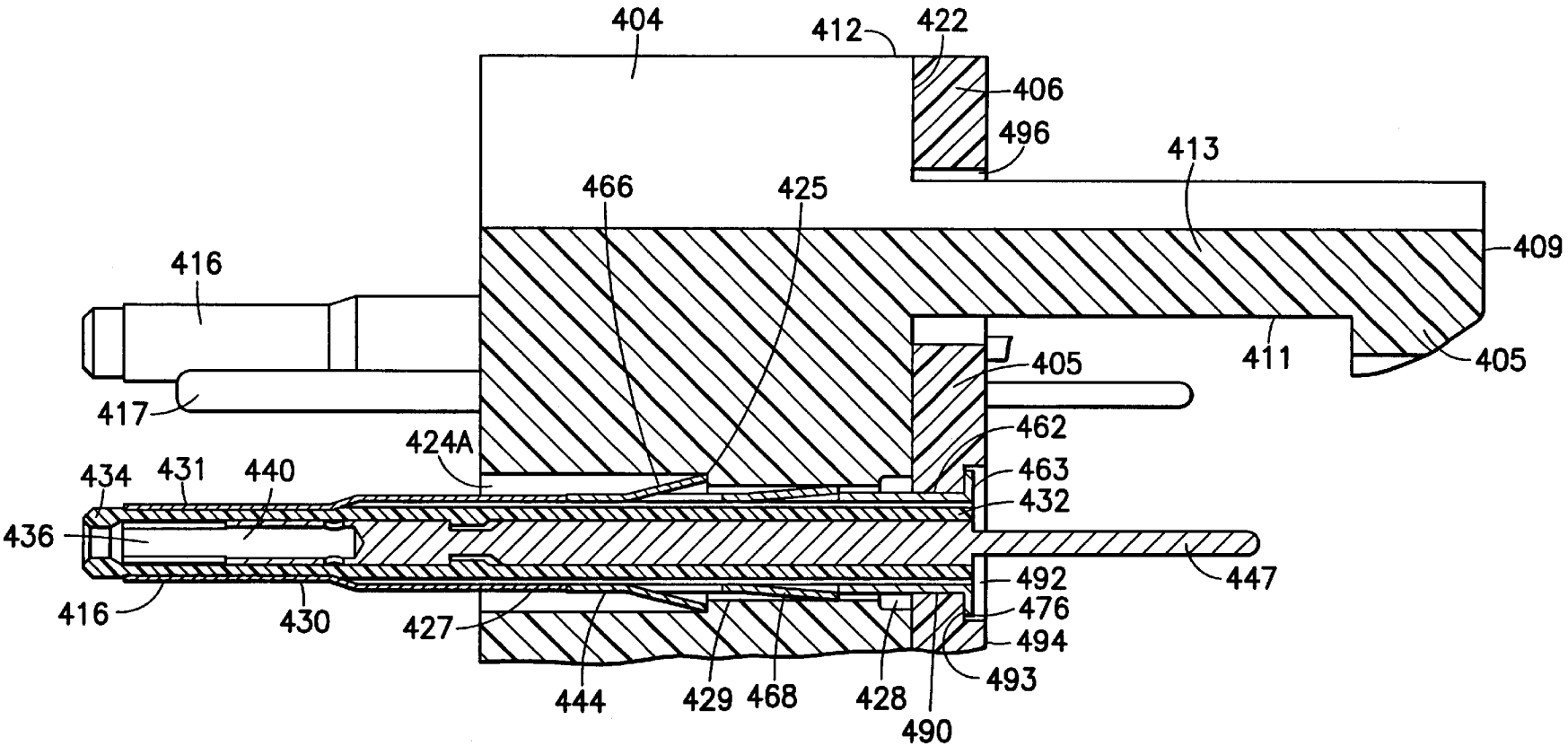
FIG. 7 is a partial cross-sectional view of an insulating housing section and grounding plate of the connector shown in FIG. 6.

Referring now also to FIG. 7, the insulating housing section 412 is generally similar to the insulating housing 12 described previously and shown in FIG. 1, except as otherwise noted below. The insulating housing section 412 is preferably a one piece member made of suitable insulating material. The housing section 412 has contact holding channels 424, 424A–424B, 426 formed therethrough. In the preferred embodiment, contact holding channels 424, 424A–424B have a larger bore, suitable for holding coaxial contacts. Such as the term TRIM TRIO™ contacts, than holding channels 426. In alternate embodiments, the housing section may have contact holding chambers of any suitable size as desired. FIG. 7 shows the cross-sectional profile of one of the contact holding channels 424A, which is representative of the inner profile of the larger bore contact holding chambers 424, 424A–424B in the insulating housing section 412. As seen in FIG. 7, the channel 424A has an inner radial step or collar 425 which defines a front section 427 and a rear section 429 of the channel. The front section 427 thus has a larger core than the rear section 429. The rear section 429 may have a counterbore 428 at the rear face 422 of the housing section 412.

The insulating housing section 412 preferably has a pair of resiliently flexible latch arms 413 depending from the rear face 422 of the housing section 412 (only one of the pair of arms 413 is shown in FIGS. 6–7). In alternate embodiments, the replaceable housing section 404 may have any other suitable latching means for latching to the adapter section 408. The latch arms 413 are disposed on the housing diametrically opposite each other. In the preferred embodiment, the latch arms 413 are located at the edge of the insulating housing 412, though in alternate embodiments the latch arms may be located at any other suitable location on the insulating housing 412. As seen best in FIG. 7, each latch arm 913 has a catch or detent 415 projecting from an inner side 411 of the latch arm. In the preferred embodiment, the latch 415 is located at the rear end 409 of the arm 413. In alternate embodiments, the catch may be located at any suitable location on the arm.

Still referring to FIGS. 6–7, the coaxial contacts 416 in the replaceable housing 404 are substantially similar to contacts 16 described previously and shown in FIG. 2A, except as otherwise noted below. Similar features are similarly numbered. Coaxial contact 415 comprises an outer shell or grounding contact 430, an inner or signal contact 432, and an insulating bushing 434 isolating the inner contact from the outer shell. A retention sleeve 444 is disposed around the outer shell 430. In this embodiment, the coaxial contact 416 is depicted as a male coaxial contact, and has a front receptacle section 431. In alternate embodiments, the coaxial contacts may be a socket or female coaxial contacts. The inner contact 432 has a front section 436 with a chamber 440 for mating with a complementing pin contact (not shown) of a mating receptacle (not shown). The inner contact 432 ends in a terminal post 447 which projects from the end 476 of the contact 716. The insulating bushing 434 is disposed around the inner contact 432, covering the inner contact 432 except for the terminal post 447 (see FIG. 7). The outer shell 430 generally surrounds the insulating bushing 434. The rear 462 of the outer shell 430 is bent outwards forming an exterior outer flange 463 located at the rear 476 of the contact. The retention sleeve 444 on the contact has two pairs of resiliently flexible lances 466, 468. The coaxial contact is assembled in a manner substantially similar to that described previously for contact 16.

Still referring to FIGS. 6 and 7, the grounding plate 406 is preferably a one piece member. The grounding plate 406 has a generally flat plate shape which conforms substantially with the exterior of the insulating housing section 412. The grounding plate 406 may be cut or stamped from a suitable metal such as aluminum or copper alloy having desirable conductivity properties. The grounding plate 406 defines a common grounding plane 405. In alternate embodiments, the grounding plate may have any suitable shape, and may be a composite piece made from any suitable materials. For example, to reduce weight, portions of the grounding plate may be made of plastic. A common grounding plane may then be disposed around the plastic sections such that top and bottom surfaces of the grounding plate are connected to the common grounding plane. As seen in FIG. 7, grounding plate 406 has through holes 490 formed therein. The through holes in the grounding plate 406 correspond to the holes 424, 424A–424B, 426 in the insulating housing 412. Preferably, all holes 490 in the grounding plate are grounded to the common grounding plane 405. Through holes 490 in the grounding plate, which correspond to the housing holes 424, 424A–424B adapted for holding coaxial contacts 416, have a counterbore 492 formed in a rear surface 494 of the grounding plate. As shown in FIG. 7, the bore of through holes 490 is sized to align a coaxial contact 416 with the retention sleeve 444 thereon to pass through the hole. The bore of hole 490 prevents the outer flange 463 at the end 476 of the contact 416 from passing through the hole. The counterbore 492 is sized to admit therein the flange 463 on the contact. The grounding plate 406 includes two cutouts 496 conforming to the pair of latch arms 413 extending from the insulating housing section 412 (only one cutout 416 is shown in FIGS. 6 and 7) The grounding plate 406 is attached to the rear face 422 of the insulating housing section 412 as seen in FIG. 7. In the preferred embodiment, the plate 406 is attached to the housing section 412 using a suitable adhesive such as epoxy. In alternate embodiments, the grounding plate may be affixed onto the housing section using any suitable mounting means such as fastening, pinning or staking.

The replacement housing section 404 is assembled in a manner substantially as follows. The grounding plate 406 is preferably installed on the insulating housing section 412 prior to installation of the coaxial contacts 416 into the insulating housing section. After the grounding plate is mounted on the insulating housing section, the contacts 416, 417 may be installed. By way of example, each coaxial contacts 416 is installed by inserting the contact front first through the hole 490 in the grounding plate 406. As the coaxial contact 416 passes through hole 490 into the housing 412, the front lances 466 and rear lances 468 are respectively resiliently compressed against the outer shell 430 by the rim 493 of the hole 490. The contact is inserted forwards into the housing 412 until the front lances 466 pass the radial step 425. The front lances 466 then resile outwards and engage the radial step 425 as shown in FIG. 7 to prevent the contact from being withdrawn from its installed position. In the installed position, the flange 463 on the outer shell 430 of the contact is located in the counterbores 492 and abuts the rim 493 of hole 490 in the grounding plate 406. Engagement between the flange 463 and rim 493 prevents the contact 416 from being pulled forwards out of the installed position shown in FIG. 7. After the contacts 416, 417 are installed in the housing, the contacts are soldered to the grounding plate 406. By way of example, in the case of contact 416, a solder ring (not shown) may be placed in the counterbore 492 and the grounding plate 460 may be heated. This solders the outer shell 430 of the contact 416 to the grounding plate effecting a ground connection between contact and common ground plane 405 of ground plate 406. The terminal post 447 of the inner contact 432, which extends through the ground plate, remains isolated from the ground plate 406.

Figure 8:
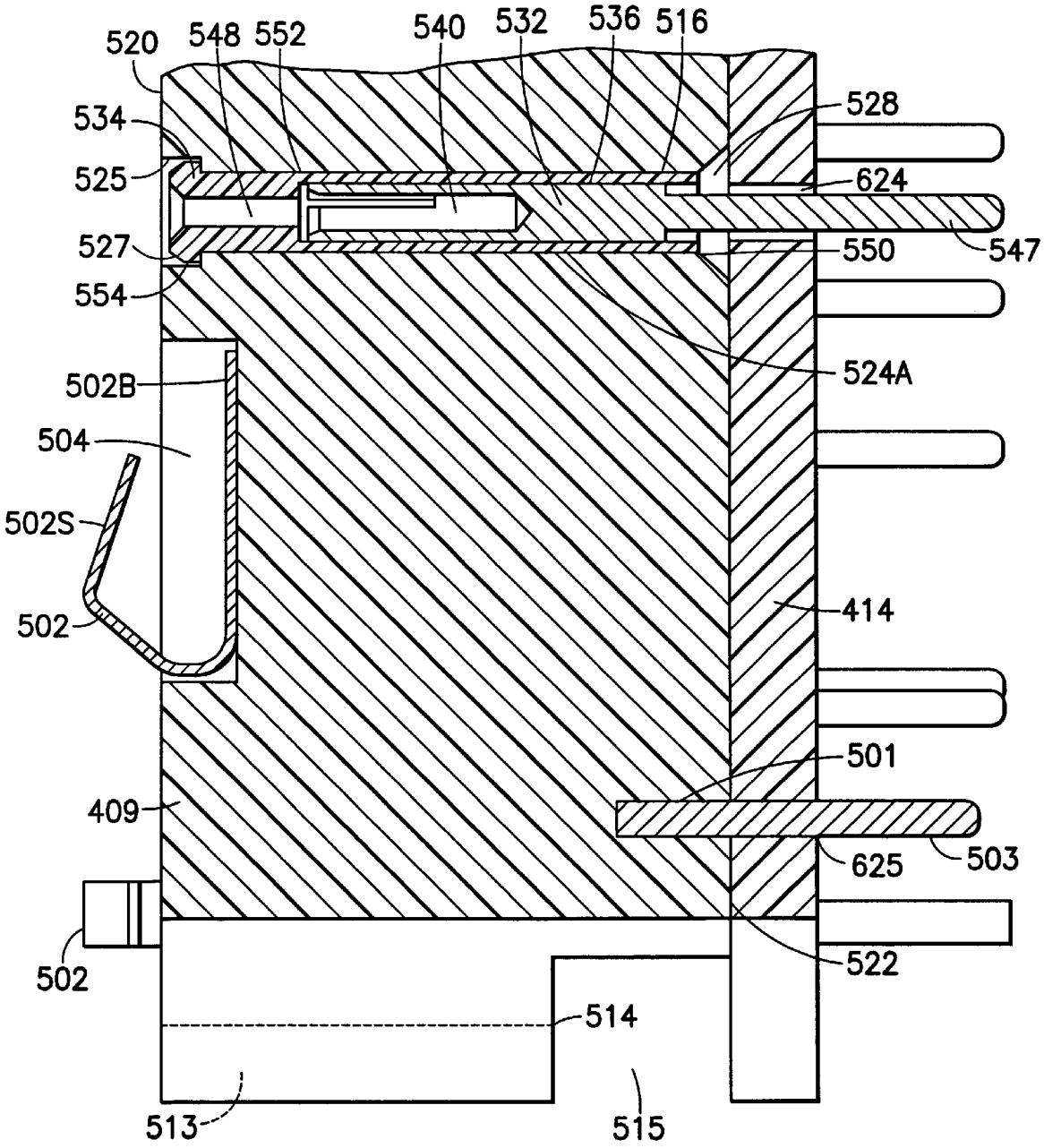
FIG. 8 is a partial cross-sectional view of an adapter section of the connector shown in FIG. 6.

As noted previously, and referring now to FIGS. 6 and 8, the adapter sections comprises conducting block 409 and PCB section 414. The conducting block 409 is preferably a one piece member cut or stamped from metal plate or formed by any other suitable means from suitable metal such as steel, aluminum or copper alloy. In the preferred embodiment, the conducting block 409 has a generally cylindrical shape conforming to the outer perimeter of the replaceable housing section 404. In alternate embodiments, the conductive block may have any other suitable shape. As seen in FIG. 6, the conductive block 409 has contact channels 524, 524A–524B, 526 formed therein. The contact channels 524, 524A–524B, 526 correspond to the contact holding channels 424, 424A–424B, 426 in the replacement housing section 404 of the connector. By way of example, when the replaceable housing section 404 and adapter section 408 are mated together, channel 524A in the conducting block 409 communicates with chamber 424A in the replaceable section 404, channel 524B communicates with channel 424B and so on. Contact channels 524,524A–524B extend through the conducting block 409 from front 520 to rear 522. Each contact channel has a front counter bore 527 which forms an inner step 525 in the channel (FIG. 8 shows the internal profile of channel 524A for example purposes. The profiles of channels 524, 524B, 526 are substantially similar). The rear opening of the channel is chamfered 528.

Still referring to FIGS. 6 and 8, the outer surface 523 of the conducting block 409 has two longitudinal slots 513 formed therein. The longitudinal slots 513 are sized and shaped to receive the flexible latch arms 413 on the replaceable housing 404. The conducting block also has two transverse notches 515 at the rear face 522 of the conducting block (only one notch 515 can be seen in FIG. 6, the other being located diametrically opposite is hidden in this view). The longitudinal slot 515 on each side of the block 409 intersects the notch 515 on that side to form shoulder 514 (see FIG. 8). Each notch 515 has sufficient depth to allow the latch 415 (see FIG. 7) on the latch arms 413 to be fully engaged by shoulder 514. In the preferred embodiment, the front face 520 of the conducting block has three slotted recesses 504 for springs 502 (see FIG. 6). The slotted recess 504 are disposed generally equally around the front face 520 of the conducting block 409. In alternate embodiments, the conducting block may have any suitable number of contact spring locating recess formed therein. The conducting block 409 preferably has two blind contact holes 501 formed in the rear face 522 of the block (FIG. 8 shows only one hole 501 for example purposes). The two blind contact holes 501 are located on the rear face diametrically opposite each other or at any other suitable locations. The holes 501 are sized and shaped to form a forced fit with grounding pins 503. In alternate embodiments, the conducting block may have any suitable number of holes for holding grounding controls therein.

As shown in FIG. 8, contact assemblies 516 generally comprise a signal contact 532, and insulating bushing 534 (only one contact assembly is shown in FIG. 8 for example purposes). The signal contact 532 preferably has a cylindrical shape such as a screw machined contact made from suitable metal. The signal contact 532 includes a body section 536 from which depends a terminal post 547. Preferably, the body section 536 includes a front chamber 540 sized and shaped to matingly receive, for example, the terminal post 447 of a corresponding contact in the replaceable housing section 404. In alternate embodiments, the signal contact of the adapter section may be a male pin contact with a pin contact portion to be mated into a receptacle of a mating contact in the replaceable housing section. The insulating bushing 534, of each of the contact assemblies 516 in the adapter section 408, is made from a suitable insulating material and has a hollow cylindrical shape sized to surround the signal contact 532. The insulating bushing has an inner shoulder 552 which defines front 548 and rear 550 sections of the bushing. The rear section 550 has a bore sized to admit the body section 536 of the signal contact. The front section 548 has a smaller bore which does not admit the signal contact therein. The front of the bushing has an enlarged outer lip 554 as shown in FIG. 8. The contact pin assembly 516 is formed by inserting the signal contact 532 into the rear section 550 of the bushing 534. The signal contact 532 is inserted until it abuts the collar 552 inside the bushing 534. In the installed position, the bushing covers the body section 536 of the contact 530 as shown in FIG. 8.

Contact springs 502 are preferably made out of flat metal strips, cut or stamped out of sheet metal. Each contact spring 502 is bent over itself forming flat base section 502B and an upper spring arm 502S as shown in FIG. 8. The spring is sufficiently wide to be stably held in the holding recess 502 of the conducting block. The spring arm 502S is generally curved so that when the spring 502 is placed in the locating recess 504 with the base 502B against the bottom of the recess, the arm 502S extends out of the recess 504. As shown in FIG. 8, the grounding pins 503 may be a metal post having any suitable shape. The cross section of the grounding pins 503 is sized to conform to the contact hole 501 in the conducting block 408.

Still referring to FIGS. 6 and 8, the PCB section 414 may be generally similar to PCB sections 14, 214, 314 described previously and shown in FIGS. 3–5. The PCB section 414 has plated contact holes 624, 625 formed therein. The contact holes 624, in the ?CB section correspond to the contact channels 524, 524A–524B, 526 in the conducting bloc. Two holes 625 in the PCB section correspond to the blind holes 501 for grounding pins 503 in the conducting block. The PCB section 414 has traces (not shown) connecting the contact holes 624, 625 to corresponding signal and ground solder pads (not shown) to which the signal and ground leads of conductors, such as for example conductor A' are terminated.

The adapter section 408 of the connector is assembled substantially as follows. The ground contact springs 502 are placed as shown in FIG. 8 in the respective locating recesses 504. The contact springs 502 may be secured to the connecting block by any suitable means such as solder, brazing, or mechanical finishing. The ground pins 503 are pass fit into contact holes 501. Bushings 534 of contact assemblies 516 are inserted into respective contact channels 524, 524A–524B, 526. Each A*bushing 534 may be installed through the front counterbore 527 into the channel 524 until the enlarged lip 554 abuts the front step 525. With the bushing 534 in the installed position, the signal contact 532 may be inserted, through the rear, into the bushing within the contact channel. Alternatively, the contact assembly comprising of insulating bushing and signal contact may be installed as a unit.

Figure 9A:
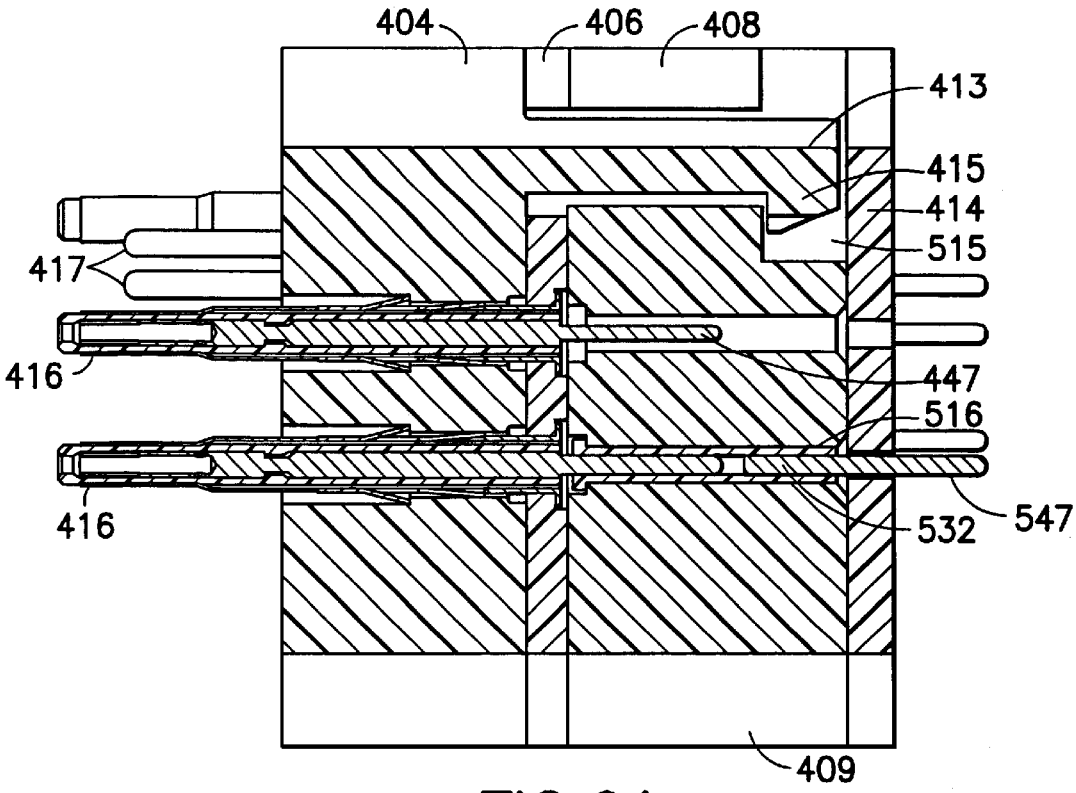
FIGS. 9A–9B are respectively a first cross-sectional view of the connector showing contact pins in the replaceable housing section mated to contact pins in the adapter section, and a second cross-sectional view showing a contact spring biased between the replaceable housing section and the adapter section of the connector.
Figure 9B:
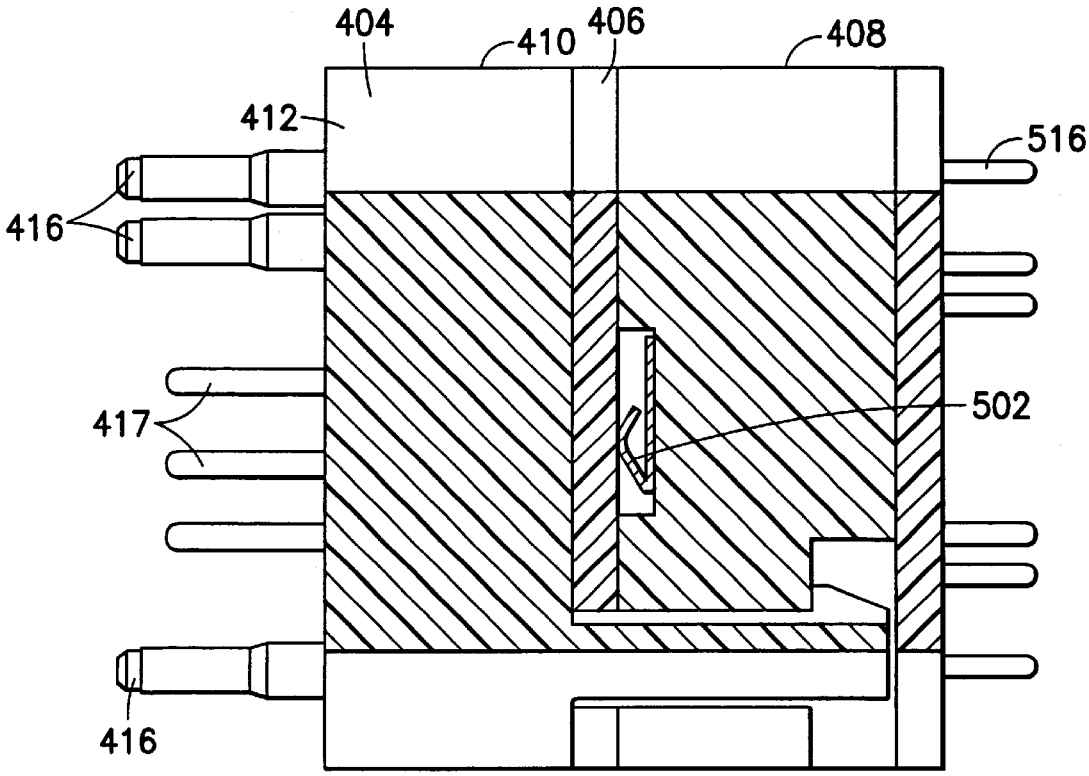

With the contacts 516, 503 installed in the conducting block 409, the PCB section 414 is assembled with the conducting block. As shown in FIG. 8, the terminal posts 547 of the respective signal contacts 516 and the grounding pins 503 extend through the PCB section 414. The signal posts 547 and grounding pins 503 are soldered to the PCB section 414 by heating the adapter section to flow the solder. As in the other embodiments, the terminal posts and grounding pins may be connected to the PCB section substantially in one step. Moreover, the solder connection between the PCB section 414 and the terminal posts 547 and grounding pins 503 anchors the PCB section to the conducting block 409. The conductors, such as for example conductor A', may be terminated to the PCB section at the same time the posts and pins 547, 503 are soldered to the PCB section 414 as described previously. The adapter section 408 and the replaceable housing section 404 may then be mated together simply by pressing the section together until the latch arms 413 snap into slots 515. As shown in FIG. 9A, when the adapter and replaceable housing sections 408, 404 are mated together, the terminal posts 447 of signal contacts 432 in coaxial contacts 416 are mated to the signal contacts 532, in contact assemblies 516. Thus, the signal contacts 532 of coaxial contacts 416 in the replaceable housing 404 are connected to the PCB section 414 and to the appropriate conductors terminated to PCB section 414. Spring arms 502S of the contact springs 502 on the adapter section 408 are biased against the grounding plate 406 forming grounding contact between the conducting block 409 and grounding plate (see FIG. 9S). Hence, the grounding outer contact 430 of the coaxial contacts 416 grounded to the grounding plate 406 as previously described, are in turn grounded to conducting block 409, and further through grounding pins 503 in the block to the PCB section 414. To remove the replaceable housing section 404 from the adapter section 408, the flexible latch arms 413 are deflected radially outwards to disengage catches 415, and the two sections 404, 408 may be pulled apart.

Figure 10:
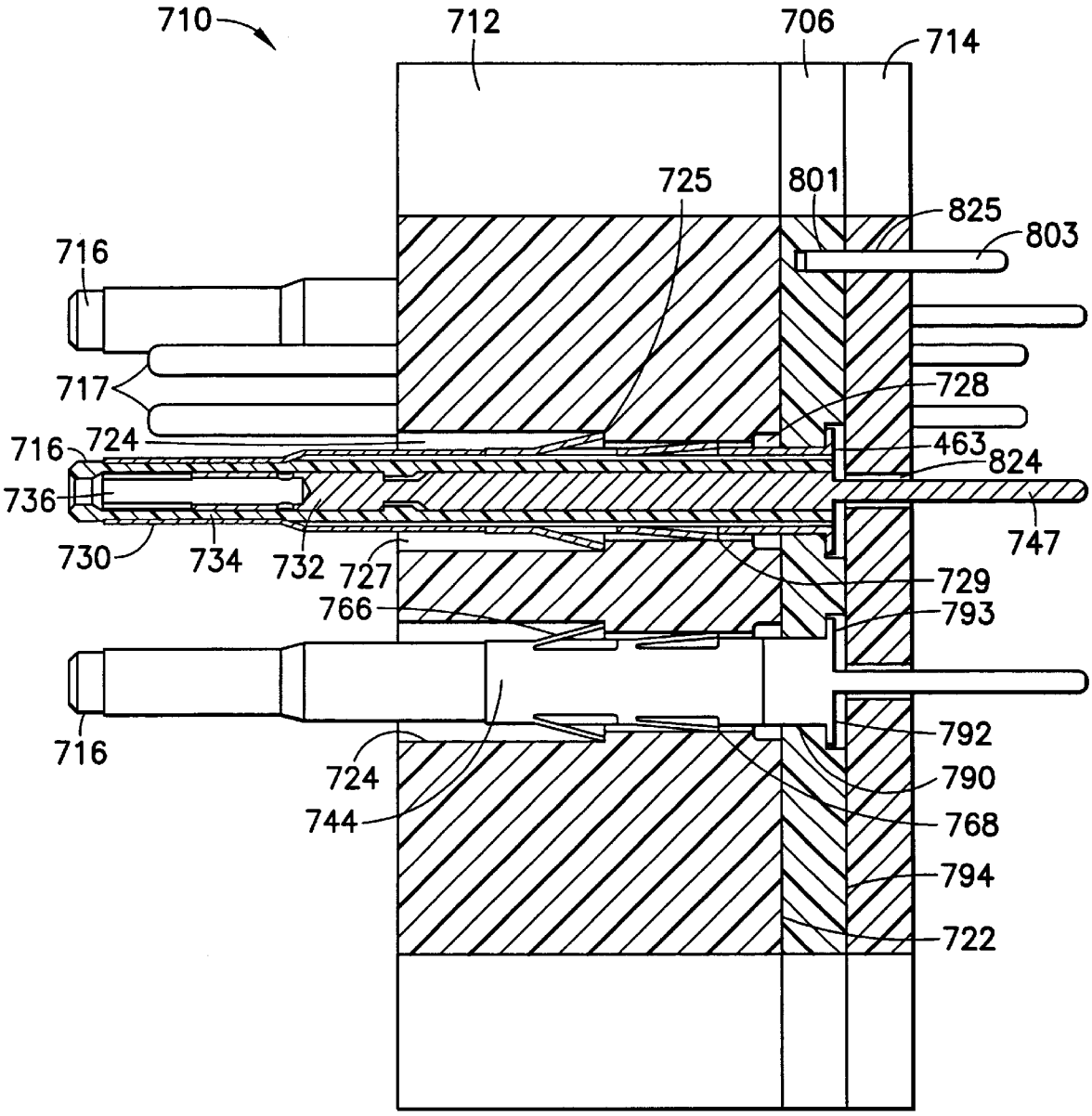
FIG. 10 is a cross-sectional view of a pin and socket connector in accordance with a fifth preferred embodiment of the present invention.

Referring now to FIG. 10, there is shown a cross sectional view of a pin and socket connector 710 incorporating features in accordance with a fifth preferred embodiment of the present invention. The connector 710 in this embodiment is generally similar to the connector 410 described previously and shown in FIGS. 6–8, 9A–9B, except as noted otherwise. Connector 710 generally comprises insulating housing section 712, grounding plate 706, and PCB section 714. The connector 710 further includes coaxial contacts 716 and pin contacts 717 which are connected to the PCB section 714 to which conductors (not shown) may be terminated.

Insulating housing section 712 is substantially similar to insulating housing section 412 described before with reference to FIGS. 6 and 8. Insulating housing section 712 has contact holding chambers 724 for coaxial contacts 716. The insulating housing section 712 also has contact holding channels (not shown) for pin contacts 717. Each contact holding channel 724 has an inner shoulder 725 which segregates the channel into a front portion 727 and a rear portion 729. The front portion 727 has a larger diameter than the rear portion 729. The rear portion has a counterbore 728 formed at the rear face 722 of the housing section.

The grounding plate 706 is substantially similar to grounding plate 406 in FIGS. 6 and 8. Grounding plate 706 contact holes 790 corresponding to the contact holding chambers 724 in the insulating housing. Each hole is counterbored 792 at the rear face 794 of the grounding plate. The grounding plate 706 further includes grounding pin holes 801. In the preferred embodiment, the grounding plate has two grounding pin holes 801 located as desired (only one hole 801 is shown in FIG. 10 for example purposes).

PCB section 714 is substantially similar to PCB section 414 described before. PCB section 714 has plated holes 824 corresponding to contact channels 724 in the insulating housing section. The PCB section also includes holes 825 corresponding to grounding pin holes 801 in the grounding plate 706. The contact and grounding pin holes 824, 825 in the PCB section 714 are respectively connected by traces (not shown) disposed-on the PCB section to contact and ground solder pads (not shown) used for terminating conductors to the PCB section 714.

The coaxial contacts 716 in the connector 710 are substantially similar to coaxial contacts 416 described previously. Coaxial contacts 716 include an outer grounding contact 730, an inner signal contact 732 and an insulating bushing 734. A retention sleeve 744 is disposed around the grounding contact 720. The insulating bushing 734 surrounds the body 736 of the signal contact 732. The terminal post 747 of the signal contact extends outside the bushing 734. The grounding contact 730 wraps around the insulating bushing 734. The rear of the grounding contact 730 is bent outwards forming a radial flange 463 The retention sleeve 744 disposed around the grounding contact 730, is made from metal, though in alternate embodiments the retention sleeve may be non-metallic. The retention sleeve has integral first 766 and second 768 sets of resiliently flexible lances.

The connector 710 is assembled in the following manner, though any other suitable method may be used. The grounding plate 706 is mounted to the rear face 722 of the insulating housing section 712. The grounding plate 706 may be bonded, such as with a suitable epoxy adhesive, or mechanically fastened to the insulating housing section. Coaxial contacts 716 and pin contacts 717 may then be installed in the insulating housing section 712. The coaxial contacts 716 are inserted through the holes 790 in the grounding plate 706 and into the contact housing channels 724 in the insulating housing section 712. The coaxial contacts 716 are in the installed position when the first set of lances 766 pass shoulder 725 and snap outwards as shown in FIG. 10.

Engagement between the resilient lances 766 and shoulder 725 prevent withdrawal of the contacts 716 from insulating housing. Engagement of the lances 766 against shoulder 725 also aids in drawing the radial flange 463 of the grounding contact 730 against the base 793 of the counterbore 792 in the grounding plate 706. The grounding pins 803 are press fit into holes 801 in the grounding plate 706, and pin contacts 717 may be installed through the appropriate holes (not shown) in the grounding plate into the insulating housing section 712. The PCB section 714 may then be assembled or stacked to the end face 794 of the grounding plate 706. The terminal posts 747 of the signal contact 732 extend through holes 824 in the PCB section 714. Grounding pins 803 extend through holes 825. The terminal posts 747 and grounding pins are soldered to the PCB section by heating the PCB section. This effects a connection between the terminal posts 474 or the signal contacts to corresponding signal solder pads, and between the grounding pins 803 and corresponding grounding solder pads on the PCB section.

The present invention provides a multi-contact pin and socket connector with integrated terminations for coaxial cable systems. This connector 10 of the present invention may be used equally with coaxial, or twisted pair conductors as previously described. However, in the case of micro-coaxial conductors, such as coaxial conductors wherein the inner signal/power conductor has a 40 AWG or smaller gage, the connector 10 of the instant invention provides significant advantages. The small size of 40 AWG or smaller gage conductors (e.g. a 40 AWG micro-conductor has a 0.003" diameter) makes termination of the conductor to conventional contacts of prior art connectors difficult, inconsistent, and time consuming. With conventional contacts such as the TRIM TRIO™ contacts of prior art connectors, the signal conductor has to be discretely terminated to the signal contact and the outer sheathing, of the coaxial conductors, has to be inserted into the annular gap between the inner contact and outer shell of the terminal section of the contact. The terminal section of the contact has then to be crimped, or soldered individually on the conductors. This operation has to be repeated for every contact in the connector. The small size of the contacts, and conductors involved may result in little feedback to the installer during installation, thereby limiting the installers ability to determine if the conductors are properly inserted into the connector, and if the connector is properly crimped onto the conductors without damaging the conductors. Improper insertion, or damage to the conductors when connecting conductors to the contact, results in a poor connection between conductors and contacts. This is eliminated in the present invention. The present invention provides a connector 10 with integrated terminations for coaxial cable systems. The connector 10 of the present invention has a modular construction with a standard interface capable of using conventional contacts such as the TRIM TRIO™ coaxial contacts, or any other suitable contacts, and provides a consistent and easy to fabricate connection between the cables and contacts. The connector 10 provides visual inspection of all terminations which is very difficult with the prior art connectors.

In comparison to prior-art multi-contact connectors the multi-contact connector of the present invention provides integrated termination for micro-coax cable systems, has a modular, low profile configuration, standard interface for existing TRIM TRIO™ coax contact system, easy repair for changing damaged connector modules, and consistent ground connection. The multi-contact connector 10 further provides visual inspection of all terminations, which is not available with terminations used in the prior art. In addition, the connector 10 of the present invention has low resistance termination for the inner-conductor of small gage coax wire using available soldering techniques. Furthermore, the multi-contact connector 10 provides low resistance, common or discrete ground termination using grounding louvers that maintain consistent contact normal force and resistance, using multiple lances, to the grounding sleeve 18. This provides uniform shielding of signal through the body of the contact and transitioning to the PCB section to maintain reliable connection to the shield of the coax cable.

It should be understood that the foregoing description is only illustrative of the invention. Various alternatives and modifications can be devised by those skilled in the art without departing from the invention. For example, although, in the preferred embodiments, the termination scheme of the signal contacts 32, 432, 742 and of the grounding posts 86 or pins 503, 803 to the PCB section 14, 474, 714 has used through mounting, in alternate embodiments, the signal contacts and grounding post or pins may be terminated to the PCB section in any other suitable manner such as surface mounting the contacts to the PCB sections. The multi-contact connector 10, 410, 710 of the present invention may be used in medical applications for endoscope and other such equipment, to facilitate a reliable, consistent, repairable, replaceable connection that is not provided by prior art connectors. Accordingly, the present invention is intended to embrace all such alternatives, modifications and variances which fall within the scope of the appended claims.

What is claimed is:

1. A pin and socket electrical connector comprising:

an insulating housing portion with contact holding channels formed therein, and having at least one coaxial contact located in a corresponding one of the contact holding channels;

a grounding portion connected to the insulating housing portion, the grounding portion having a ground plane which is groundingly connected to a grounding contact of the at least one coaxial contact in the insulating housing portion; and an adapter portion connected to the insulating housing, the adapter portion interfacing between a conductor terminated to the connector and the at least one coaxial contact in the insulating housing portion, wherein the grounding plane of the grounding portion is sandwiched between the insulating housing portion and the adapter portion of the connector.

2. An electrical connector in accordance with claim 1, wherein the adapter portion has a contact holding channel with a signal contact held therein, the signal contact in the adapter portion being matingly connected to a signal contact of the at least one coaxial contact in the insulating housing portion of the connector.

3. An electrical connector in accordance with claim 1, wherein the insulating housing portion is removably mounted to the adapter portion of the connector.

4. An electrical connector in accordance with claim 1, wherein the adapter portion comprises a conducting section with contact holding channels formed therein, and a printed circuit board (PCB) section connected to the conducting section, and wherein the conducting section groundingly contacts the grounding plane of the grounding section, and the PCB section is disposed on the conducting section for terminating the conductor to the PCB section when the conductor is terminated to the connector.

5. An electrical connector in accordance with claim 4, wherein the conducting portion has a projecting member depending therefrom and extending through the PCB section.

6. An electrical connector in accordance with claim 1, further comprising a spring biased between the grounding portion and the adapter portion of the connector for effecting grounding contact between the grounding plane of the grounding portion and the adapter portion of the connector.

7. An electrical connector in accordance with claim 1, wherein the insulating housing has a pair of resiliently flexible arms depending therefrom and engaging complementing recess in the adapter portion for removably mounting the insulating housing on the adapter portion.

8. A pin and socket electrical connector comprising:

an insulating housing with contact holding channels formed therethrough;

at least one coaxial contact mounted in the insulating housing, the at least one coaxial contact including a ground contact and a signal contact, and being located in a corresponding one of the contact holding channels of the insulating housing;

a grounding section connected to the insulating housing, the grounding section having a ground plane which is groundingly connected to the ground contact of the at least one coaxial contact; and a printed circuit board (PCB) section connected to the insulating housing, the PCB section interfacing between a conductor terminated to the connector and the at least one coaxial contact.

9. An electrical connector in accordance with claim 8, wherein the insulating housing, the grounding section, and the PCB section are assembled in a stack with the grounding section being disposed between the insulating housing and the PCB section of the connector.

10. An electrical connector in accordance with claim 8, wherein the signal contact of the at least one coaxial contact extends through the PCB section of the connector.

11. An electrical connector in accordance with claim 8, wherein the grounding section includes a grounding post protecting from the grounding section through the PCB section.

12. A method for terminating an electrical conductor to an electrical connector, the method comprising the steps of:

providing the electrical connector with an insulating housing having contact holding channels formed therein, and at least one pin or socket co-axial contact located in one of the contact holding channels;

providing the electrical connector with an adapter section adapted to be removably mounted to the insulating housing, the adapter section having signal contact assemblies therein corresponding to the contact holding channels in the insulating housing;

mounting a terminal plate to the adapter section, the terminal plate having contact holes, at least some of which hold therein corresponding terminal ends of the signal contact assemblies, the contact holes being connected to solder pads for terminating electrical conductors thereto;

heating the terminal plate to effect a connection between the terminal ends of the signal contact assemblies and the electrical conductors terminated to the solder pads; and removably mounting the adapter section to the insulating housing for connecting the at least one pin or socket co-axial contact to at least one of the electrical conductors terminated to the solder pads on the terminal plate.

13. A method in accordance with claim 12, further comprising the step of connecting a grounding plane to the insulating housing for groundingly connecting the at least one pin or socket co-axial contact to the grounding plane, wherein the grounding plane is located between the insulating housing and the adapter section when the adapter section is removably mounted to the insulating housing.

14. A pin and socket electrical connector comprising:

an insulating housing with contact holding channels formed therethrough;

at least one contact mounted in the insulating housing, the contact being held in one of the contact holding channels in the housing with a terminal section of the contact extending from a portion of the housing; and a printed circuit board (PCB) section connected to the housing, the PCB section interfacing between a conductor terminated to the connector and the at least one contact;

wherein the at least one contact is a co-axial contact with the terminal section of the contact comprising an outer terminal contact, and an inner terminal contact co-axial with the outer terminal contact, the inner terminal contact having an end connected to the PCB section.

15. A pin and socket electrical connector in accordance with claim 14, further comprising an adapter section disposed between the insulating housing and the PCB section, the terminal section of the co-axial contact being groundingly connected to the adapter section.

16. A pin and socket electrical connector in accordance with claim 15, wherein the adapter section is removably connected to the insulating housing.

17. A pin and socket electrical connector in accordance with claim 15, wherein the PCB section is mounted to the adapter section.

18. An electrical connector in accordance with claim 14, wherein the PCB section is connected to the portion of the housing from which the terminal section of the at least one contact extends, and wherein the terminal section is terminated-to the PCB section.

19. An electrical connector in accordance with Claim 18, further comprising at least one grounding sleeve mounted in the insulating housing, the grounding sleeve being located in the contact holding channel holding the contact, wherein the contact is groundingly connected to the grounding sleeve.

20. An electrical connector in accordance with claim 19, wherein the co-axial contact is located within the grounding sleeve with the outer terminal contact in contact with the grounding sleeve.

21. An electrical connector in accordance with claim 19, wherein the co-axial contact comprises an outer shell, and an inner contact member within the outer shell, the inner contact member having a front contact portion which is sized and shaped to be complementarily coupled to a mating contact in a receptacle.

22. An electrical connector in accordance with claim 21, wherein the outer shell has a sleeve mounted thereon, the sleeve having a first set of resiliently flexible lances extending therefrom for retaining the coaxial contact in the contact holding channel of the insulating housing, and a second set of resiliently flexible lances biased against the grounding sleeve to effect contact between the outer shell of the co-axial contact and the grounding sleeve.

23. An electrical connector in accordance with claim 19, wherein the grounding sleeve has a mounting post depending therefrom for connecting the grounding sleeve to the PCB section.

24. An electrical connector in accordance with claim 23, wherein the PCB section has at least one plated grounding hole formed therein for receiving the mounting post on the grounding sleeve therein and effecting contact between the grounding sleeve and the PCB section, and wherein the PCB section has at least another plated hole for receiving the inner terminal contact of the co-axial contact therein and effecting termination of the inner terminal contact to the PCB section.

25. An electrical connector in accordance with claim 24, wherein the grounding hole is connected to a common grounding plane on the PCB section, the common grounding plane on the PCB section being connected to one or more grounding conductors.

26. An electrical connector in accordance with claim 24, wherein the PCB section has several of the plated grounding holes formed therein, each of the plated grounding holes being connected to a discrete grounding pad on the PCB section corresponding to the grounding hole, each discrete grounding pad on the PCB section being connected to a corresponding grounding conductor.

27. An electrical connector in accordance with claim 24, wherein the at least another plated hole in the PCB section is connected to a conductor contact pad on the PCB section, the conductor contact pad being disposed on the PCB section for soldering the electrical conductor to the conductor contact pad.

28. An electrical connector in accordance with claim 24, wherein the mounting post on the grounding sleeve in the at least one plated grounding hole, and the inner terminal contact in the at least one other plated hole in the PCB section, are soldered in the respective holes substantially simultaneously when the PCB section is heated.

* * * * *